US006907650B1

(12) United States Patent
Stephens

(10) Patent No.: US 6,907,650 B1
(45) Date of Patent: Jun. 21, 2005

(54) PIPE PLUG PULLER

(76) Inventor: Jerome S. Stephens, 7458 Texas Ave., Mentor, OH (US) 44060

( * ) Notice: Subject to any disclaimer, the term of this patent is extended or adjusted under 35 U.S.C. 154(b) by 236 days.

(21) Appl. No.: 10/423,723

(22) Filed: Apr. 25, 2003

(51) Int. Cl.[7] ..... B25B 27/16
(52) U.S. Cl. ..... 29/267; 29/237
(58) Field of Search ..... 29/267, 234, 237, 29/239

(56) References Cited

U.S. PATENT DOCUMENTS 2,759,383 A * 8/1956 Mrazik ..... 81/3.57
3,966,169 A 6/1976 Schosek
4,249,293 A 2/1981 Schulberg
4,633,957 A 1/1987 Prost
4,780,942 A * 11/1988 Bernat ..... 29/219
4,796,347 A 1/1989 Aguillen, Jr. et al.
5,003,682 A 4/1991 Strausbaugh et al.
5,014,409 A * 5/1991 Hippach ..... 29/267
5,079,791 A * 1/1992 Grech ..... 7/169
5,465,430 A 11/1995 Davis et al.
5,778,740 A 7/1998 Tye
6,086,048 A 7/2000 Owen

* cited by examiner

*Primary Examiner*—Robert C. Watson
(74) *Attorney, Agent, or Firm*—Forrest L. Collins Law Offices, LLC; Forrest L. Collins

(57) ABSTRACT

Pipe plugs are difficult to remove due in part to the design of the pipe plug to be extremely tight fit with a pipe. Pipe plugs are described as being removed by a pipe plug removal tool. The pipe plug removal tool permits easy access to a trench and employs leverage to remove the pipe plug.

14 Claims, 2 Drawing Sheets

PIPE PLUG PULLER

BACKGROUND OF THE INVENTION

1. Field of the Invention

The present invention relates to the removal of pipe plugs from pipes. A pipe plug is a protective device a portion of which is inserted into an opening in a pipe. A pipe cap is a protective device which is placed over the outer surface of a pipe to seal a pipe opening.

2. Description of the Art Practices

U.S. Pat. No. 4,796,347 issued to Aguillen Jr. et al., on Jan. 10, 1989 discloses a plastic-pipe puller tool for installing subterranean utility pipes has a shaft portion, one tapered end on the shaft portion for snugly fitting within the inner wall of the plastic pipe to be installed and a second coupling end which may have a coupler which is rotatably supported from the shaft portion, to permit rapid and easy joining of the plastic pipe to the pipe-pulling means, whether a bore-pipe or a pneumatic hose.

U.S. Pat. No. 4,633,957 issued to Prost Jan. 6, 1987 discloses a soil plugging and ejecting apparatus for being inserted into soil to form and remove a soil plug and for ejecting the plug. The apparatus includes an elongate tubular body having a cutting edge on its lower end for piercing the soil to form a plug. A step attached to the body receives downward pressure to force the apparatus into the soil and a grip attached to the upper end of the body provides a means for holding and guiding the apparatus, and for pulling it out of the soil after the plug is formed. A valve mounted on the apparatus is in fluid-flow communication with a source of pressurized fluid and the body, and is operable to selectively admit pressurized fluid into the body to eject a plug from the lower end of the body. The valve can be actuated by a handle or a button.

U.S. Pat. No. 4,249,293 issued to Schulberg Feb. 10, 1981 contains a disclosure of a pulling tool of generally elongated shape operable by hydraulic pressure to pull force-fitted elements from an anchorage, such as cups from the arms of universal joints. At the forward end there is a gripping sleeve to be located around the element, a retaining sleeve to be located about the gripping sleeve and a reaction sleeve around the retaining sleeve. Interaction of the walls of the gripping sleeve and retaining sleeve cause transverse contraction of the gripping sleeve about the element as the hydraulic pressure pulls the gripping sleeve rearwardly. An ejector pin urges the element longitudinally from the tool after the arms constituting the gripping sleeve open, which occurs due to differing radial forces applied on the gripping sleeve as it moves rearwardly. The leading edge of the reaction sleeve reacts against the anchorage from which the element is pulled.

Schosek in U.S. Pat. No. 3,966,169, which issued Jun. 29, 1976, recites a rod and pipe pusher, puller device for operative attachment to a conventional type of tractor or truck mounted backhoe machine without removal of the backhoe bucket. The attachment of operation of the device is accomplished by the removal of a single pin from the drive linkage to the bucket from a hydraulic operated piston of the conventional mechanism of the backhoe machine. Means are provided to securely anchor the bucket to an upper central portion of the device and to connect said drive linkage to a power arm of the device to accomplish the rod and pipe pushing, pulling operation.

U.S. Pat. No. 6,086,048 Owen issued Jul. 11, 2000 discloses a board puller for removing boards on a structure generally having a board cue which contacts the back side of boards to be removed, a fulcrum with a pivot that interacts with the frame structure and a handle for providing leverage. The board cue is pivotally attached towards one end of the fulcrum. The handle is rigidly attached to the other end of the fulcrum, but made so that the angle can be adjusted, in the preferred embodiment. In the center of the fulcrum is a pivot typically consisting of a curved or semi-circular member extending perpendicular for the fulcrum. Gauges are provided which are attached to the board cue. The gauges positions and holds the board cue on the boards being removed. This provides a means to remove the board in such a manner that splintering and board breakage is minimized. The board puller can be used with or without the gauges. In operation, the board cue is positioned behind the boards to be pulled or removed. The pivot on the fulcrum is positioned on the stud, joist or other frame structure on which the boards are nailed or screwed. The handle is then either pulled or pushed to remove the boards from the structure. The handle angle can be adjusted to provide the best angle for applying leverage.

U.S. Pat. No. 5,778,740 issued to Tye on Jul. 14, 1998 recites a bottle cap remover is activated by inserting a bottle into an orifice. A detector adjacent the orifice detects the presence of the bottle and causes a linear actuator to drive a gripping device away from the top of the bottle where the cap is located. As the gripping device is moving away from the bottle cap, cam members direct hooked members of the gripping device around the bottle cap so that it is pulled off of and away from the bottle as the linear actuator drives the gripping device away from the bottle top. Once the bottle cap is removed, the linear actuator recycles to ready the bottle cap remover for the next bottle cap.

Davis et al., in U.S. Pat. No. 5,465,430 Nov. 14, 1995 contains a disclosure of a cap glide puller comprising an elongated handle. A head is longitudinally offset at one end of the handle. A hook diagonally extends downwardly from the offset end of the handle towards the head. The head and the hook are capable of engaging a cap glide on a free end of a chair leg. When the handle is manually lifted up, the cap glide will be removed from the free end of the chair leg.

Strausbaugh, et al. in U.S. Pat. No. 5,003,682 that issued Apr. 2, 1991 discloses a tool assembly for removing caps or plugs from sewer lines to be connected by contractors or plumbers. The tool includes three distinct pieces which may, in conjunction, be slid over a cap or plug to be removed. A screw element is then turned to pull the cap or plug from a sewer line without damage to the cap or line itself. The tool is designed for rapid attachment and use to reduce time consumed and danger to contractors and plumbers working on a sewer connection.

To the extent that the foregoing patents are relevant to the present invention they are herein incorporated by reference. Ratios and ranges may be combined.

SUMMARY OF THE INVENTION

The present invention describes a generally U-shaped pipe plug puller comprising:

- a base region of the U-shaped pipe plug puller;
- a first leg extending from said base region;
- a second leg extending from said base region;
- said first leg extending from said base region and said second leg extending from said base region such that said first leg and said second leg are substantially parallel to one another;
- a first foot region extending from said first leg;
- a second foot region extending from said second leg;

said first foot region of said first leg being in a plane different than the first leg;

said second foot region of said second leg being in a plane different than the second leg region;

said first foot region of said first leg and said second foot region of said second leg being substantially parallel to one another;

said first foot region of said first leg terminating in a first apex distally from said first leg;

said second foot region of said second leg terminating in a second apex 32 distally from said second leg;

a first raised section extending along said first leg and along said first foot region;

a second raised section extending along said second leg and along said second foot region;

said first raised section and said second raised section being substantially parallel to one another;

said first raised section and said second raised section terminating at a location distal from the first apex and the second apex respectively.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE INVENTION

Figure 1:
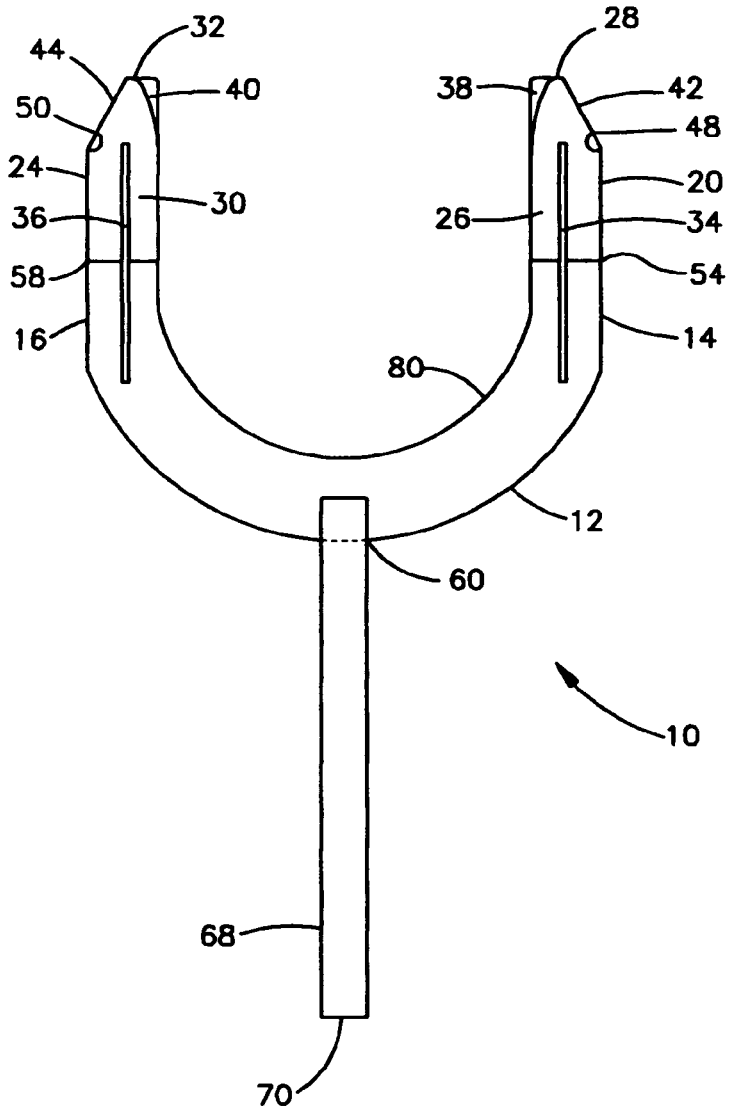
FIG. 1 is a plan view of an aspect of the present invention.

As best seen in FIG. 1 is a generally U-shaped pipe plug puller 10. The U-shaped pipe plug puller 10 has a base region 12. The base region 12 of the U-shaped pipe plug puller 10 is generally semi circular. The base region 12 has a first leg 14. The base region 12 has a second leg 16.

The first leg 14 and the second leg 16 are generally symmetrical. The first leg 14 has extending therefrom a first foot region 20. The second leg 16 has extending therefrom a second foot region 24. The first foot region 20 and the second foot region 24 are generally symmetrical.

A first raised section 34 is connected with said first leg 14. The first raised section 34 is also connected with said first foot region 20. The first raised section 34 spans the first leg 14 and first foot region 20. The first raised section 34 has a height, a width, and a thickness. The first raised section 34 is generally perpendicular to the first leg 14. The first raised section 34 is also generally perpendicular to the first foot region 20.

The length of the first raised section 34 spans the first leg 14 and first foot region 20. The width of the first raised section 34 arises from the first leg 14 and first foot region 20. The thickness of the first raised section 34 is attached to the first leg 14 by means of welding. The thickness of first raised section 34 is attached to the first foot region 20 by welding. The length of said first raised section 34 along said first foot region 20 is about 1¾ to 2¼ times the length of said first raised section 34 along the length of said first leg 14.

A second raised section 36 is connected with said second leg 16. The second raised section 36 is connected with said second foot region 24. The second raised section 36 spans the second leg 16 and second foot region 24. The second raised section 36 has a height, a width, and a thickness. The second raised section 36 is generally perpendicular to the second leg 16. The second raised section 34 is also generally perpendicular to the second foot region 24. The length of said second raised section 36 along said second foot region 30 is about 1¾ to 2¼ times the length of said second raised section 36 along the length of said second leg 20.

The length of the second raised section 36 spans the second leg 16 and first foot region 20. The width of the second raised section 36 arises from the second leg 16 and first foot region 20. The thickness of the second raised section 36 is attached to the second leg 16 by means of welding. The thickness of second raised section 36 is attached to the second foot region 24 by welding. The overall length of the first raised section 34 and the overall length of the second raised section 36 are each about 1½ to 2½ times the length of said first raised section 34 and said second raised section along the length of said first leg 14 and the length of the second leg 16 respectively. The length of the first leg 14 and second leg 16 are approximately equal.

A first toe section 28 extends from the first foot region 24. A narrowing segment 38 partially defines the first toe section 28. The first toe section 28 generally comes to a point at the end the distal to the first foot region 24.

A second toe section 32 extends from the second foot region 30. A narrowing segment 40 partially defines the second toe section 32. The second toe section 32 generally comes to a point at the end the distal to the second foot region 30. The 28 and the 38 directly oppose one another.

The first toe section 28 is at least partially defined by a beveled section 42 extending along the first foot region 26 toward the first toe section 28 and formed by an angle 48 along the outside of the first second foot region 30. The second toe section 32 is at least partially defined by a second beveled section 44 extending along the second foot region 30 toward the second toe section 40 and formed by an second angle 50 along the outside of the second foot region 30.

A first oblique angle 54 is at the juncture of the first leg 14 and the first second foot region 30. A triangle is at least partially defined by the first oblique angle 54. The sides of the triangle as defined by the first oblique angle 54, are the first leg 14 and the first foot region 20 and the first raised section 34.

Figure 2:
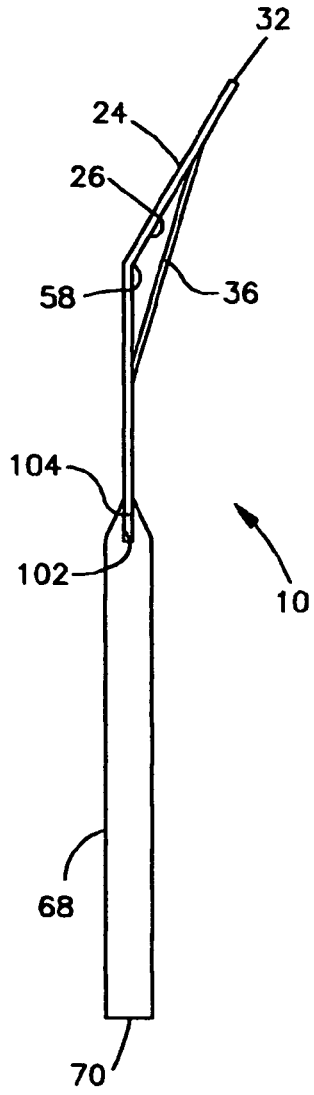
FIG. 2 is a left side view according to FIG. 1.
Figure 3:
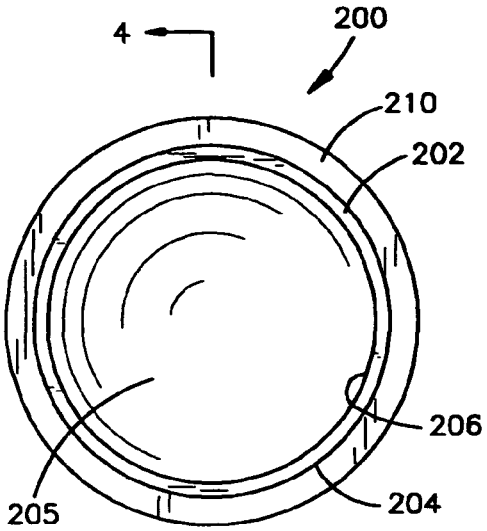
FIG. 3 is a bottom view of a pipe plug.

A second oblique angle 58 is at the juncture of the second leg 16 and the second foot region 30. A triangle is at least partially defined by the second oblique angle 58. The sides of the triangle as defined by the second oblique angle 58, are the second leg 16 and the second foot region 30 and the second raised section 36. The a first oblique angle 54 and the second oblique angle 58 are each preferably about 170° to 155°. As best seen in FIG. 2, the base region 12 is joined to an attachment segment 60. The attachment segment 60 comprises a generally cylindrical shaped pipe 68. The generally cylindrically shaped pipe 68 has located at one end an opening 70 to permit a shovel handle (not shown) or a second piece of pipe of a suitable inside diameter to fit within the generally cylindrical shaped pipe 68 to provide suitable leverage to the base region 12 when desired.

The attachment segment 60 further comprises a slot 102 cut through a diameter of the attachment segment 60. A tongue section 104 of the base region 12 extends into the slot 102 in the attachment segment 60. The generally cylindrical shaped pipe 68 is attached to the base region 12 in a tongue in groove manner. The tongue in groove connection of the generally cylindrical shaped pipe 68 to the base region 12 may be suitably effected such as by welding, riveting, or nut and bolt connection.

As best seen in section 4 is a bottom view of a pipe plug 200. The pipe plug 200 is comprised of a pipe plug wall segment 202. The pipe plug wall segment 202 has an outer surface 204. The pipe plug 200 has an inner wall surface 206. The inner wall surface 206 of the pipe plug 200 is connected to pipe plug wall segment 202 such that there is a flange 210 extending away from the outer surface 204. The flange 210 at least partially defines the outer surface 214 of the pipe plug 200.

The base region 12 is generally circular with regard to the inner edge 80 of the base region 12. The overall shape of the base region 12, the first leg 14, the second leg 16, the first foot region 26, and the second foot region 30 is that of a horseshoe. The first oblique angle 54 at the inner edge 80 of the base region 12 and the second oblique angle 58 at the inner edge 80 of the base region 12 form a diameter of a circle. The dimensions of the diameter of the circle are slightly greater than the outer surface of the diameter pipe plug puller 10 as measured across the inner edge 80 at the closest point of the first oblique angle 54 and the second oblique angle 58. Conveniently, as the outer surface of pipe puller is slightly smaller than the inner surface of the pipe the diameter of the circle will be approximately equal to the diameter of the outer surface of the pipe from which the pipe plug 200 is to be removed.

Figure 4:
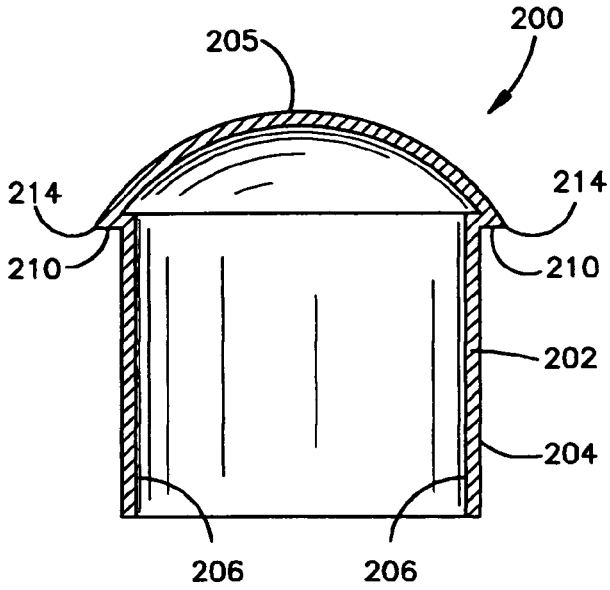
FIG. 4 is a sectional view taken a long lines 4—4 of FIG. 3; and, FIG. 5 is a partial sectional view of a pipe.
Figure 5:
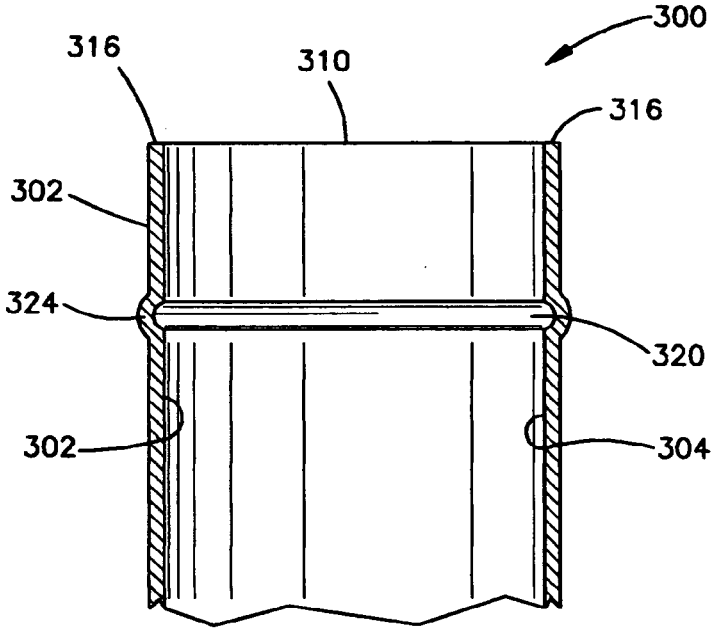

As best seen in FIG. 4, is a partial sectional view of the pipe plug 200. As seen in FIG. 5 is a conventional plastic pipe 300. The plastic pipe 300 has an outer pipe wall 302. The plastic pipe 300 has inner pipe wall 304. The plastic pipe 300 has an opening 310 to permit the flow of material through the plastic pipe 300. An outer pipe surface 316 of the plastic pipe 300 at least partially defines the opening 310. The plastic pipe 300 has an enlarged bell region 320 to permit and elastomeric seal to be fitted into the plastic pipe 300. The plastic pipe 300 has in conjunction with the enlarged bell region 320 an expanded diametric portion 324 to permit insertion of the elastomeric seal or O-ring (not shown).

In practice, it is desirable to seal a pipe 300 whenever the pipe 300 will be left unattended for any period of time. By sealing the pipe 300 unwanted debris will not enter the chamber of the pipe and the pipe 300 will not require cleaning prior to beginning work again. The pipe 300 will typically be placed in an excavation site (trench) such that the pipe 300 tightly fits into the excavation site. In this manner, the excavator need only remove as much soil as is necessary for the pipe 300 to be placed in the excavation site.

A pipe plug 200 as shown in FIG. 4 will be inserted into a pipe 300. The outer surface 204 of the pipe plug wall 202 will engage the inner pipe wall 304 of the pipe 300. The diameter of the type 200 at the pipe plug 204 will be approximately the same size as the diameter of the inner pipe wall 304 of the pipe 300. The pipe plug 200 will typically be inserted into the pipe 300 until the flange 210 engages the surface outer pipe surface 316.

The U-shaped pipe plug puller 10 according to the present invention is utilized in the relatively confined excavation site to remove the pipe plug 200. In practice, the present invention permits the relatively a limited access at an excavation site to remove a pipe plug 200 from the pipe 300 without undue difficulty.

The U-shaped pipe plug puller 10 is sized to permit the inner edge 80 of the base region 12 to fit snugly over the 204 of the pipe plug 200. The narrowing segment 38 and the narrowing segment 40 being relatively sharpened surfaces engage in the area between the 210 of the pipe plug 200 and the 316 of the plastic pipe 300. To provide the leverage a shovel handle (not shown) is fitted into the opening 70 of the attachment segment 60.

The U-shaped pipe plug puller 10 is then forced with the open end into the excavation site over the 210 and the 316 until the side surface of the first raised section 34 and the side surface of the second raised section 36 begins to engage the outer surface 214 of the pipe plug 200.

The U-shaped pipe plug puller 10 is then further urged past first oblique angle 54 and the second oblique angle 58 until the U-shaped pipe plug puller 10 is substantially contacting the 80. The U-shaped pipe plug puller 10 is then in a generally perpendicular position to the pipe plug 200 and the pipe 300 while the pipe plug 200 and pipe 300 are still firmly engaged. The U-shaped pipe plug puller 10 is then rotated in the relative direction of the pipe plug 200 by means of the lever action exerted in the attachment segment 60. The U-shaped pipe plug puller 10 is continuously rotated in the direction of the pipe plug 200 until the pipe plug 200 is fully removed from the pipe 300. Other methods of attempting to remove a pipe plug 200 from a pipe 300 may involve utilizing the blade of a shovel or the like. However, the pipe plug 200 or the pipe 300 may be cracked or broken. In the case of the pipe plug 200 breakage will eliminate the reuse of the pipe plug 200 and the existing pipe plug 200 will still have to be removed from the pipe 300. The damage to the pipe 300 may mean that the pipe 300 will have to be removed back to the last junction with another section of the pipe 300. Even moderate damage to the pipe 300 may cause improper seal of the enlarged bell region 320 which may not be detected until the excavation site is backfilled and the plastic pipe 300 is pressurized.

The pipe plug puller 10 of present invention provides a simple tool for the removal of a pipe plug 200 from a plastic pipe 300. The pipe plug puller 10 may also be utilized as an aid in pulling pipe caps from a pipe.

What is claimed is:

1. A generally U-shaped pipe plug puller comprising:

a base region of the U-shaped pipe plug puller;

a first leg extending from said base region;

a second leg extending from said base region;

said first leg extending from said base region and said second leg extending from said base region such that said first leg and said second leg are substantially parallel to one another;

a first foot region extending from said first leg;

a second foot region extending from said second leg;

said first foot region of said first leg being in a plane different than the first leg;

said second foot region of said second leg being in a plane different than the second leg region;

said first foot region of said first leg and said second foot region of said second leg being substantially parallel to one another;

said first foot region of said first leg terminating in a first apex distally from said first leg;

said second foot region of said second leg terminating in a second apex distally from said second leg;

a first raised section extending along said first leg and along said first foot region;

a second raised section extending along said second leg and along said second foot region;

said first raised section and said second raised section being substantially parallel to one another;

said first raised section and said second raised section terminating at a location distal from the first apex and the second apex respectively.

2. The generally U-shaped pipe plug puller according to claim 1, wherein said first leg and said first foot region are at an angle of about 170° to 155° facing said first raised section.

3. The generally U-shaped pipe plug puller according to claim 1, wherein the length of said first raised section along said first foot region is 1½ to 2½ times the length of said first raised section along the length of said first leg.

4. The generally U-shaped pipe plug puller according to claim 1, wherein the length of said first leg and said second leg is approximately equal.

5. The generally U-shaped pipe plug puller according to claim 1, wherein the length of said first foot region and said second foot region is approximately equal.

6. The generally U-shaped pipe plug puller according to claim 1, wherein the width of said first leg and said second leg is approximately equal.

7. The generally U-shaped pipe plug puller according to claim 1, wherein the width of said first foot region and said second foot region is approximately equal.

8. The generally U-shaped pipe plug puller according to claim 1, wherein the thickness of said first leg and said second leg is approximately equal.

9. The generally U-shaped pipe plug puller according to claim 1, wherein the thickness of said first foot region and said second foot region is approximately equal.

10. The generally U-shaped pipe plug puller according to claim 1, further comprising a point of attachment located at the center of said base region and extending from said base region in a direction diametrically opposite to said first leg.

11. The generally U-shaped pipe plug puller according to claim 1, further comprising a point of attachment located at the center of said base region and extending from said base region in a direction diametrically opposite to said first leg, and wherein said point of attachment and said first leg are substantially in the same plane.

12. The generally U-shaped pipe plug puller according to claim 1, wherein said point of attachment is generally cylindrical.

13. The generally U-shaped pipe plug puller according to claim 1, wherein the length of said first raised section along said first foot region is 1¾ to 2¼ times the length of said first raised section along the length of said first leg.

14. The generally U-shaped pipe plug puller according to claim 1, wherein said first leg and said first foot region form a first angle and said second leg and said second foot region form a second angle wherein a straight line between said first angle and said second angle defines a diameter of said base region.

* * * * *